US006269725B1

(12) United States Patent
Cherry

(10) Patent No.: US 6,269,725 B1
(45) Date of Patent: Aug. 7, 2001

(54) FLUID-FILLED BOMB-DISRUPTING APPARATUS AND METHOD

(75) Inventor: Christopher R. Cherry, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/366,285

(22) Filed: Aug. 2, 1999

(51) Int. Cl.[7] ..... F41A 19/57

(52) U.S. Cl. ..... 86/50; 89/1.13; 102/306; 102/310; 102/475

(58) Field of Search ..... 86/50; 102/306, 102/308, 310, 475, 476; 89/1.13

(56) References Cited

U.S. PATENT DOCUMENTS

| | | | | |
|---|---|---|---|---|
| 3,358,780 | * | 12/1967 | Venghiattis | 102/308 |
| 4,046,055 | | 9/1977 | McDanolds et al. | 86/50 |
| 4,169,403 | | 10/1979 | Hanson | 86/50 |
| 4,187,782 | * | 2/1980 | Grace | 102/475 |
| 4,628,819 | | 12/1986 | Backofen, Jr. et al. | 102/307 |
| 4,955,939 | | 9/1990 | Petrousky et al. | 102/476 |
| 4,957,027 | | 9/1990 | Cherry | 89/1.14 |
| 5,936,184 | * | 8/1999 | Majerus et al. | 89/1.13 |

FOREIGN PATENT DOCUMENTS

| | | | | |
|---|---|---|---|---|
| 581668 | * | 2/1994 | (EP) | 86/50 |

OTHER PUBLICATIONS

Chick, M., et al., "Predictable Disposal of Munitions with Shaped Charges," Materials Research Laboratory, DSTO, Melborne, Australia, date unknown, 1–18.

James, H.R., "TTCP WAG–11 Bullet/Fragment Protocol (Version 2.0)," AWE (Foulness), UK, Nov. 1993, 1–16.

Mader, Charles, et al., "Jet Initiation of Explosives," Los Alamos National Laboratory report LA–8647, Feb. 1981, 1–9.

Moulard, H., "Critical Conditions for Shock Initiation of Detonation by Small Projectile Impact," date unknown, 316–324.

* cited by examiner

*Primary Examiner*—J. Woodrow Eldred
(74) *Attorney, Agent, or Firm*—Timothy D. Stanley

(57) ABSTRACT

An apparatus and method for disarming improvised bombs are disclosed. The apparatus comprises a fluid-filled bottle or container made of plastic or another soft material which contains a fixed or adjustable, preferably sheet explosive. The charge is fired centrally at its apex and can be adjusted to propel a fluid projectile that is broad or narrow, depending upon how it is set up. In one embodiment, the sheet explosive is adjustable so as to correlate the performance of the fluid projectile to the disarming needs for the improvised explosive device (IED). Common materials such as plastic water bottles or larger containers can be used, with the sheet explosive or other explosive material configured in a general chevron-shape to target the projectile toward the target.

In another embodiment, a thin disk of metal is conformably mounted with the exterior of the container and radially aligned with the direction of fire of the fluid projectile. Depending on the configuration and the amount of explosive and fluid used, a projectile is fired at the target that has sufficient energy to penetrate rigid enclosures from fairly long stand-off and yet is focused enough to be targeted to specific portions of the IED for disablement.

22 Claims, 2 Drawing Sheets

24
A
26
10
28
W
14
22
16
20
18
30
32
R

FLUID-FILLED BOMB-DISRUPTING APPARATUS AND METHOD

This invention was made with Government support under Contract DE-AC04-94AL85000 awarded by the U.S. Department of Energy. The Government has certain rights in the invention.

BACKGROUND OF THE INVENTION

The present invention relates generally to devices that can disrupt or disarm the circuit or components of a terrorist-type bomb, using a fluid-filled bottle with an internal explosive charge that propels the fluid at the target to disable it.

In the art of bomb-disablement, most terrorist-type bombs are generally defused remotely by a propellant-actuated, gun-type disrupter expelling water. These disrupters (generally 12-ga.) are limited in their performance to small (lunchbox or briefcase size) packages or containers. Water-bottle disrupters can deliver large quantities of energy and are capable of destroying very large targets with controlled impact pressures. These water-bottle disrupters produce low-density spatial water jets that produce high levels of energy but have limited penetration capabilities.

In the past, most terrorist-type bombs or improvised explosive devices (IEDs) were remotely defused or disrupted with a gun-type disrupter. The disrupter consisted of a metal tube or barrel containing a propellant load in the breech end and, in the remaining portion of the barrel, containing a liquid projectile such as water. In U.S. Pat. No. 4,169,403, several grams of black powder, electrically initiated, propels the liquid out of the barrel to accomplish destruction of an IED. U.S. Pat. No. 4,957,027 discloses a versatile non-electric de-armer/disrupter that is propellant-actuated that propels various projectiles or missiles at an IED to disable or destroy it. This patent further teaches the ability to fire a plurality of disrupters/de-armers with various projectiles with a high degree of simultaneity. Variations of the disrupter illustrated in U.S. Pat. No. 4,957,027 have been developed to fire oil-based and metal-loaded clay from a similar device to remotely disable an IED.

Water systems using a high explosive to propel the water are illustrated in U.S. Pat. No. 4,955,939. This patent employs a high explosive to generate a shock wave through a liquid to provide sufficient pressure to collapse a plastic liner to form a plastic precursor jet capable of penetrating and creating a small hole through thick steel barriers. It goes on to state that the plastic precursor jet first penetrates the target, creating a small hole to allow the water from the charge to follow through the small entry hole. The efficiency of this system depends on the size of the precursor hole produced. If the barrier is strong, i.e., thick steel, then a small precursor hole will be formed. If too small, then only a fraction of the water will follow through the precursor hole. Other types of water charges that are explosively driven have been used in Explosive Ordnance Disposal (EOD) in the past. One such device used high explosives to accelerate water contained in a plastic bowl to dynamically disable an IED. The shock pressure accelerated the water from the detonating explosive. The hemispherical shape of the explosive enveloping the water directed the water into a jet capable of penetrating multiple barriers. Other techniques involved the use of explosives to propel water to create a low-density, high-energy water jet capable of penetrating soft skinned IEDs containing sensitive nitroglycerin-based dynamites without initiation. These devices employed a central tubular charge in a fluidfilled container, such as a 55-gal. drum, which was then fired adjacent the target.

The prior art devices, therefore, had shortcomings. The disrupter-fired fluids, as well as the bowl surrounded by charges, impacted a target over a relatively small surface area, creating a very high pressure. The prior design involving containers with fluid fill and a centrally mounted explosive created a low-density spatial water jet that impacted a tremendous amount of the surface area. Thus, one of the objectives of the present invention is to combine the beneficial qualities of both of the previous types of devices used to disable IEDs. One of the objectives of the present invention is to be able to vary variables such as the velocity of the fluid jet, its density, its impact pressure, and the standoff or distance capability from the IED. This allows EOD personnel to adapt to the situation by configuring the apparatus to either extreme or points in between.

Accordingly, the present invention teaches a unique explosive-disabling charge that explosively propels a variety of materials at the IED in a variable manner to suit a particular situation. The inventor refers to the present invention by the name "Hydra-Jet". The present invention combines the beneficial features of gun-barrel-shaped disruptive tools as well as the water-bottle-shaped disrupter tools in a single device and builds the device from readily available materials. The present invention includes a device with a fixed charge in a particular direction with means for varying, either locally or remotely to the size and velocity of the projectile. An advantage of the present invention is the ability to vary the projectile's shape without altering the container or varying the amount of explosive. While the present invention uses a predetermined explosive charge, it has the ability to vary the projectile mass, velocity, energy and shock pressure delivered to the target. Another advantage of the present invention is to mass-focus the water or other propellant so as to forms a stable fluid projectile that is capable of delivering its energy to the target at long standoff distances in excess of 5 feet. Yet another advantage of the present invention is to present a shaped, confined charge which operates very efficiently to produce a high-energy disabling jet with a minimal amount of explosives, thus reducing the possibility of collateral damage to the surrounding area. Another advantage of the present invention is the ability to have a choice in providing a large-surface-impact-area jet for general disruption purposes or a focused or concentrated jet for more precise disruption. Another advantage is to allow variability in the projectile velocity by a factor of 4 without altering the explosive quantity in the container, while retaining the capability of providing velocities that can range from a few hundred ft/sec to several thousand ft/sec.

Another advantage of the present invention is the ability to increase the impact pressure from the projectile of the apparatus by a factor of 16, thus allowing penetration of strong barriers such as ⅛" thick steel or more without initiating the IED inside. The apparatus can be used alone or in combination with other devices that can be sequentially timed with microsecond resolution. The invention can also provide the ability to create viewing ports in conjunction with long standoff distances in the sides of trucks or other vehicles at short or large standoff distances with minimal effect to nearby property or personnel. Another advantage of the present invention is for use in the motion picture business to create special effects of fireballs by using a flammable material that is propelled explosively. The invention has the further advantage of being able to penetrate a multiplicity of layers of barrier materials and still have enough energy to disable or destroy the circuit and other components of the IED from distances as far as 5–6 feet away or more or at closer offsets. These advantages can be readily understood by those skilled in the art from a review of a detailed description of the invention below.

SUMMARY OF THE INVENTION

An apparatus and method for disarming improvised explosive devices (IED) is disclosed. The apparatus comprises a fluid-filled bottle or container made of plastic or another like material that contains a fixed or adjustable, sheet explosive. A charge is fired centrally at its apex and can be adjusted to propel a fluid projectile that is broad or narrow, depending upon how it is set up. In one configuration, the sheet explosive is adjustable so as to correlate the performance of the fluid projectile to the disarming needs for the IED. Common materials such as plastic water bottles or larger containers can be used, with the sheet explosive or other explosive material configured in a general chevron-shape to target the projectile toward the target. Depending on the configuration and the amount of explosive and fluid used, a projectile is fired at the target that has sufficient energy to penetrate rigid enclosures from fairly long stand-off distances and yet is focused enough to be targeted to specific portions of the IED for disablement.

DETAILED DESCRIPTION OF THE PREFERRED EMBODIMENT

Figure 1:
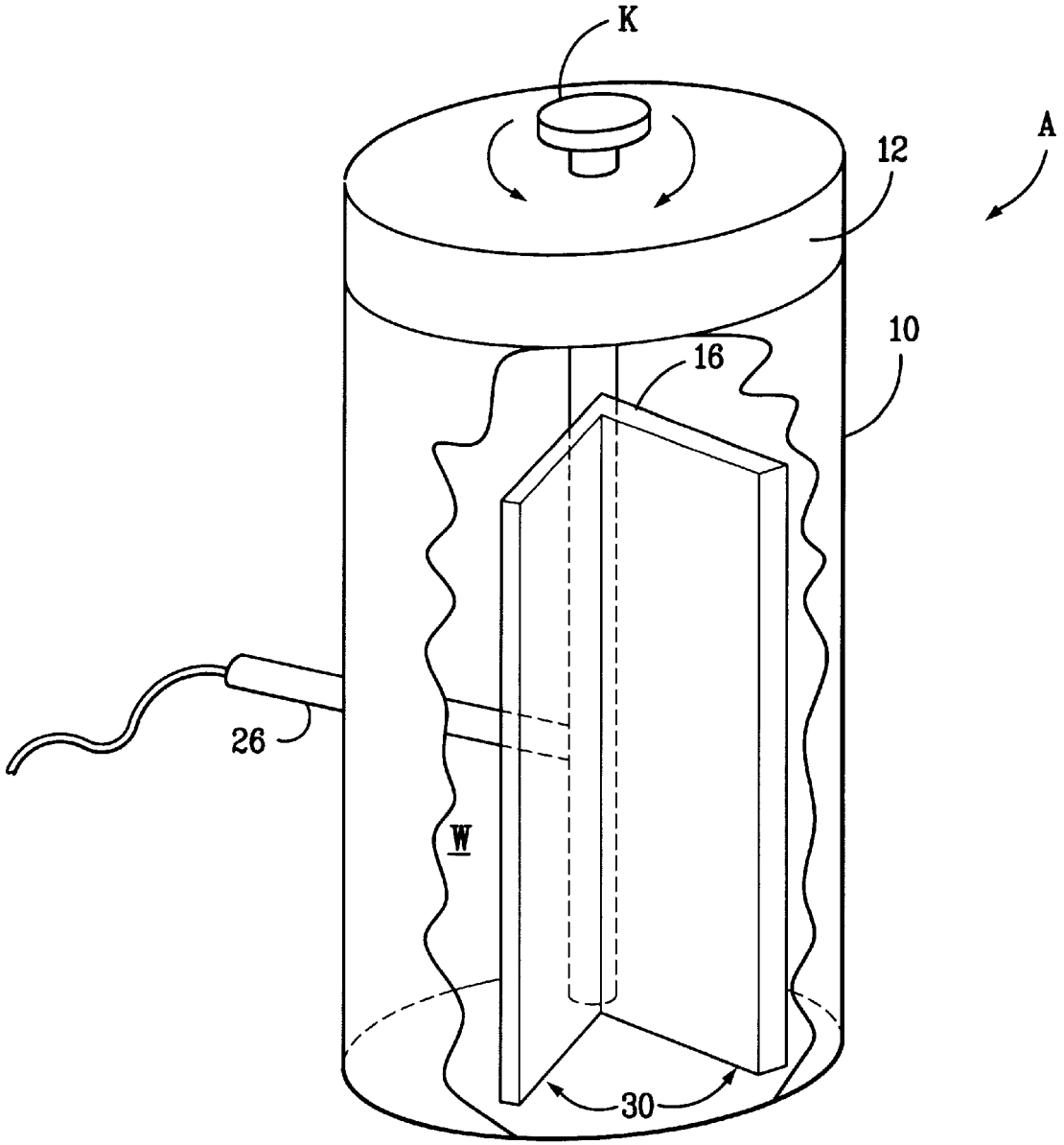
FIG. 1 is a perspective view of a variable design that allows local or remote reconfiguration of the physical size of the projectile to be fired when the apparatus is set off.
Figure 2:
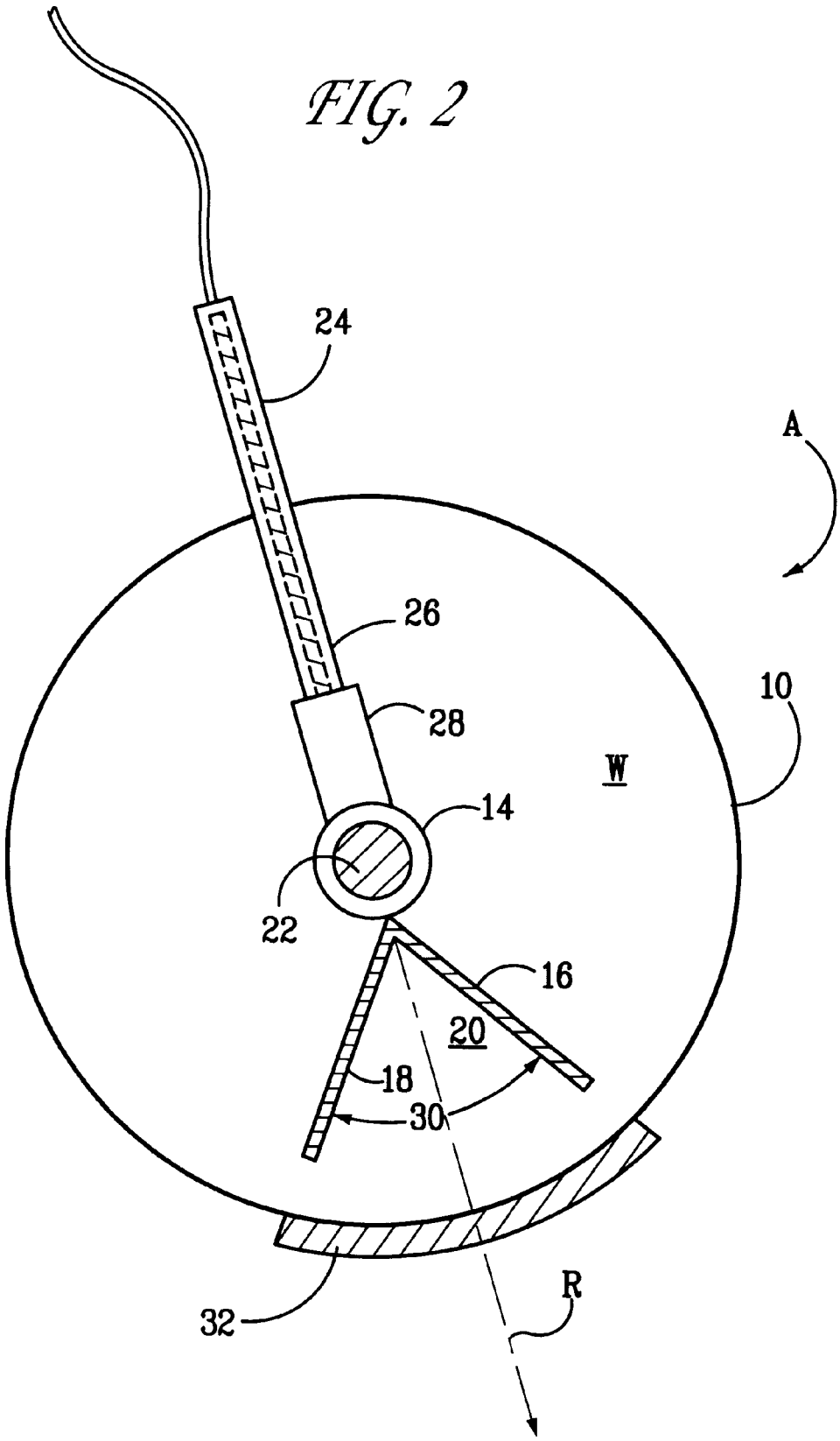
FIG. 2 is a cross sectional view of FIG. 1.

The apparatus A, as shown in FIGS. 1 and 2, comprises a thin plastic jar or container 10, having a lid 12. The jar 10 is usually rectangular or cylindrical in shape and can be one of many commercially available shapes for water bottles or drums, such as chemical drums, generally as large as about 55 gal. The jar 10 houses a plastic capped tube 14 (see FIG. 2) and a plastic linear wedge- or chevron-shaped support member 16 extending from tube 14. In the preferred embodiment, sheet explosive 18 is secured to the support member 16. In the embodiment of FIG. 2, the support member 16 orients the sheet explosive in a 90 angle, thus creating a volume 20 between the jar 10 and the sheet explosive 18 which is to be the projectile which is propelled toward the target. The sheet explosive 18 can be made of PETN (pentaerythritoltetranitrate) or RDX-based sheet explosives, with charge weights ranging from a few grams to >10 lbs. per charge. A detonating cord can be used in some cases in lieu of the explosive sheet 18. If the supporting member 16 is made from a butyrate-type plastic, the explosive sheet 18 will self-adhere to the support member 16. The sheet explosive 18 is initiated with a booster pellet of sheet explosive 22, which bisects the chevron shape formed by the explosive 18 at the rear center apex of the explosive wedge formed by the sheet explosive 18. A detonator 24 is inserted into the detonator well 26 to initiate the booster pellet 22 which is located in tube 14 at the apex of the panels of the sheet explosive 18. A plastic cap 28 prevents water from entering into detonator well 26.

When the main high explosive linear charge or sheet explosive 18 detonates, it creates a high-intensity shock or pressure wave at interference pressures ≧1 million psi that impinges upon the material adjacent to the explosive. The shock wave travels radially outward to the exterior of the container. Following this high-intense shock are several lower intensity shocks created by the expanding gaseous detonation products. Many shock reflections occur within the container. These high-intensity pressure disturbances accelerate the water or other fluid outwardly very quickly in microseconds, thus resulting in a high-velocity jet.

By initiating at the rear of the charge along the apex at tube 14, the water jet produced will be straight and knife-like, with the entire length impacting the target in a perpendicular fashion and at approximately the same time. In EOD use, it is desirable for the jet to usually impact over the target surface simultaneously. In the preferred embodiment, the explosive wedge defined by volume 20 has its apex coinciding directly with the center axis of the plastic container. The plastic container 10 is filled with water or alcohol-based water or other fluid. The fluid serves three purposes. In a majority of uses, it becomes the projectile. The fluid serves as a confinement for the explosive, which greatly enhances the charge's performance by reducing tremendously the amount of explosive required. This reduction of explosives is extremely important in reducing unwanted collateral damage to the surroundings. The water envelope greatly attenuates the unwanted air blast. Apart from using water, other fluids which include clay, water and clay combinations, thickened water or polymer, metallic loaded polymer, or combinations of the above materials, can be used as the projectile defined by the volume between the jar 10 and the sheet explosive 18.

FIG. 1 illustrates the ability to rotate manually or by an operator K which can be remotely actuated to vary the angle represented by arrow 30 between the sheets of sheet explosive 18. By changing the angle 30, the mass of the projectile can be varied, thus providing a variable velocity/energy profile to the projectile without varying the explosive sheet 18 or the configuration of the jar or container 10. As the angle 30 is decreased, i.e., from 180 to 45, the projectile mass is reduced to 25% of its former value. With a set quantity of explosive 18 and the smallest practical angle of about 45, the nominal jet velocity can be increased by a factor of 4. This velocity increase can result in increasing the impact pressure on the target by a factor of 16 because the impact pressure varies as the square of the velocity. The very high pressure can be necessary for penetrating hard or strong targets, such as steel. On the other hand, when sensitive explosives may be impacted inside the target, the lower velocity dispersed jet, i.e., the 180° position for angle 30, may be more advantageous. The ability to vary the angle 30 allows the charge to mass focus the projectile. The large angle 30, i.e., 180°, produces a dispersing spatial low-density jet that can deliver large amounts of energy at low impact pressures at short standoff distances to the target. On the other hand, the narrow angle 30, such as between 45°–90°, creates an explosive wedge of sheet explosive 18 that in turn creates a very high-shock focusing called a "mach stem" or a "bridge." This high-intensity pressure mass focuses the water or other material within the wedge between the panels of the sheet explosive 18, which in turn results in a projectile that is accelerated to a high velocity. This focusing feature resulting from a reduction of angle 30 provides the necessary integrity or higher density to the jet and enables the jet to stay together longer, thus providing for long standoff capability from the target explosive. The ability to mass focus the projectile in turn allows for penetration of multiple layers or barriers. Since the entire jar 10 is filled with water and the sheets 18 are surrounding by the water or other fluid that is used, by design the fluid inside the jar 10 surrounds the explosive 18 and provides confinement to the explosive, thus allowing the pressure generated from the explosive to be sustained for a longer period of time. This confining effect thus produces higher jet velocities with a minimum amount of explosives. Additionally, the use of sheet explosive 18 in the form of thin rectangular sheets, provides the largest explosive surface area of any geometry, thus providing the maximum efficiency for the explosive charge to propel the liquid or semi-solid or other material adjacent the explosive inside the container.

In one embodiment, the detonator 24 perpendicularly bisects the angled explosive 18 at the rear center apex of the explosive wedge that they form and mid-way up the explosive sheets 18. By initiating in the center of the charge, as determined by the apex as well as vertically, the water jet produced will be straight and knife-like, with the entire length impacting the target in a perpendicular fashion and at approximately the same time. In the preferred embodiment, the apex of the wedge that is created is at the center of the container, overlapping the center axis of the plastic container. Those skilled in the art will now appreciate that the apparatus A of the present invention combines the desirable features of the jar-type disrupters which typically used mineral water bottles but required very short stand-off distances of less than 12" and were incapable of penetrating thin steel containers, metallic vehicle bodies or multiple layers of barrier material. The apparatus A is capable of penetrating metal barriers, vehicle bodies, etc., and is capable of penetrating through multiple-layer barriers. Standoff distances in excess of 5 ft are possible with the apparatus A of the present invention. Due to the geometry of the sheet explosive 18, which gives it a large surface area in a confined space in jar 10, and the symmetrical confinement of the sheet explosive 18, the apparatus A operates very efficiently as compared to, for example, the prior art design involving a plastic bowl with sheet explosive on its outer face. In comparison, the apparatus A of the present invention can achieve the same results with only 20–30% of the amount of explosives used in conjunction with the bowl-shaped plastic container used in the prior art. The apparatus A of the present invention has the focusing capabilities of prior art barrel gun-type disrupters, yet it has built in it the capability of imparting a far greater amount of energy to the fluid projectile. This can be in the order of 50 times in excess of the power developed through the barrel-type disrupters used in the past. The apparatus A thus provides the necessary versatility to adapt to a great deal of different situations that may be encountered in EOD operations. If many layers or thick layers need to be penetrated, a variable version of the apparatus A shown in FIG. 1 can be set to a smaller angle 30, such as between 45°–90°. In other situations, where a greater stand-off is required or the bomb to be deactivated is not enclosed in a rigid enclosure, an angle 30 can be selected that is between 90°–180°.

The apparatus A can be manufactured with different amounts of explosives for sheet explosive 18 so as to give EOD personnel some leeway in the velocities achieved, even if the angle 30 in the sheet explosive 18 is fixed. Clearly, the maximum versatility can be achieved in providing the adjustment abilities using a motor drive or other adjusting mechanisms, shown schematically as K in FIG. 1.

As further depicted in FIG. 2, a disk of material 32 is conformably mounted with jar 10. By way of example, any material can be used and preferably the material is a metal such as steel, brass, copper, etc. The metal disk 32 is aligned with the direction of fire R of the fund projectile. With initiation of the device A, metal disk 32 collapses to form a wedge-like projectile as it moves towards the IED. As such, metal disk 32 provides additional mass for penetrating the exterior of the IED.

The detonation system can vary greatly among known techniques, the significant feature of the preferred embodiment being placement at the apex of the sheet explosive 18. In the preferred embodiment, the apex is coincident with the longitudinal axis of the jar 10; however, offsets can be employed without departing from the spirit of the invention. A wide variety of explosives can be used which will function adequately if they are able to define a chevron-type shape, as illustrated in FIGS. 1 and 2. The sheet explosive 18 can also have some curvature to it so as to form a general U-shape, as opposed to a V-shape illustrated in FIGS. 1 and 2, without departing from the spirit of the invention.

The foregoing disclosure and description of the invention are illustrative and explanatory thereof, and various changes in the size, shape and materials, as well as in the details of the illustrated construction, may be made without departing from the spirit of the invention.

What is claimed is:

1. An apparatus for disabling explosive devices, comprising:

a container;

an explosive material disposed in said container arranged to form a chevron and to define at least first and second zones in said container; and filler material in said zones, whereupon detonation of said explosive material, the filler material in said first zone is propelled through said container and against the explosive device.

2. The apparatus of claim 1, wherein said filler material is a fluid.

3. The apparatus of claim 2, wherein said fluid is selected from the group consisting essentially of: water, flammable liquids, alcohol, clay, polymers and combinations thereof.

4. The apparatus of claim 1, wherein said container comprises a longitudinal axis; the apex of said chevron coincides with said longitudinal axis.

5. The apparatus of claim 1, further compromising a detonating system connected to said explosive material.

6. The apparatus of claim 5, wherein said detonating system also connected midway on said apex as measured along said longitudinal axis.

7. The apparatus of claim 1, further comprising an adjustment on said explosive material to allow variation of the size of at least one zone prior to setting off said explosive material.

8. The apparatus of claim 7, wherein said explosive material comprises a sheet explosive mounted in said container so that one sheet can be moved with respect to another.

9. The apparatus of claim 8, wherein said sheets meet at an apex and at least one sheet is rotatable about said apex.

10. The apparatus of claim 9, wherein said apex is substantially aligned with a longitudinal axis of said container.

11. The apparatus of claim 10, wherein said apex coincides with said longitudinal axis of said container.

12. The apparatus of claim 7, wherein said adjustment allows the included angular displacement between different portions of said explosive material to be varied from about 45° to about 180°.

13. The apparatus of claim 7, wherein said adjustment further comprises a remotely operated motor driver.

14. The apparatus of claim 9, further comprising a detonating device connected at said apex.

15. The apparatus of claim 1, further including a metal disk conformably mounted with the exterior of the container.

16. The apparatus of claim 15, wherein, the metal disk is radially aligned with a direction of fire of the apparatus.

17. The apparatus of claim 1, wherein said filler material fills said container at the point of covering said explosive material completely.

18. A method of defusing an explosive device, comprising:

a) dividing a container into at least two zones with an explosive material;

b) substantially filling said zones with a fluid filler material and substantially covering said explosive material;

c) detonating the explosive material; and d) propelling said filler material from at least one of said zones towards the explosive device.

19. The method of claim 18, further comprising providing an adjustment feature to said explosive material to vary the volume of at least one of said zones.

20. The apparatus of claim 1, wherein said filler material fills the zones within said container so as to substantially cover said explosive material.

21. An apparatus for disabling explosive devices, comprising:

a) a container;

b) an explosive material disposed in said container arranged to define at least first and second zones in said container;

a) means for varying the volume of at least one zone; and d) filler material in said zones, whereupon detonation of said explosive material, the filler material in said first zone is propelled through said container and against the explosive device.

22. An apparatus for disabling explosive devices, comprising:

a) a container;

b) an explosive material disposed in said container to define at least first and second zones in said container; and c) fluid material in said zones filling said zones and substantially covering said explosive material, whereupon detonation of said explosive material, the fluid material in said first zone is propelled through said container and against the explosive device.

* * * * *